United States Patent [19]

Nesheim

[11] Patent Number: 4,622,956

[45] Date of Patent: Nov. 18, 1986

[54] REFLEX STIMULATOR

[76] Inventor: David A. Nesheim, 1718 Broadway, Rockford, Ill. 51108

[21] Appl. No.: 792,067

[22] Filed: Oct. 28, 1985

Related U.S. Application Data

[63] Continuation-in-part of Ser. No. 371,290, Apr. 23, 1982, abandoned.

[51] Int. Cl.[4] ..... A61H 15/00

[52] U.S. Cl. ..... 128/57; 128/60

[58] Field of Search ..... 128/57, 60, 329 A

[56] References Cited

U.S. PATENT DOCUMENTS

| | | | |
|---|---|---|---|
| 655,490 | 8/1900 | Hollem | 128/60 |
| 1,071,998 | 9/1913 | Gibbs | 128/57 |
| 3,411,498 | 11/1968 | Reiter | 128/57 |
| 3,590,821 | 7/1971 | Orlandini | 128/57 |
| 3,664,334 | 5/1972 | O'Neil | 128/57 |
| 3,750,654 | 8/1973 | Shiu | 128/57 |
| 3,831,592 | 8/1974 | Lancellotti | 128/60 |
| 3,850,163 | 11/1974 | Andis, Sr. | 128/57 |
| 3,994,289 | 11/1976 | Thomas et al. | 128/57 |
| 4,421,110 | 12/1983 | DeLisle et al. | 128/60 |
| 4,452,237 | 6/1984 | Lewis | 128/60 |
| 4,479,495 | 10/1984 | Isaacson | 128/329 A |

*Primary Examiner*—Edgar S. Burr
*Assistant Examiner*—Tonya Eckstine
*Attorney, Agent, or Firm*—Anthony S. Zummer

[57] ABSTRACT

A reflex stimulator for applying a localized force to a nerve end at a reflex point in a series of applications of localized force. The stimulator includes a handle adapted to be grasped by an operator for manipulating the reflex stimulator to apply a force to a human body. A hub having an axis of rotation is rotatably connected to the handle. A plurality of elongated teeth is mounted on the outer periphery of the hub. Each of the teeth extends radially outward from the hub and the axis of each tooth intersects the axis of rotation of the hub.

7 Claims, 6 Drawing Figures

REFLEX STIMULATOR

CROSS-REFERENCE TO RELATED APPLICATION

This application is a continuation-in-part of patent application Ser. No. 371,290, filed Apr. 23, 1982, entitled, "Reflex Stimulator", now abandoned.

BACKGROUND OF THE INVENTION

The treatment of physical disorders of the human body may be accomplished in a variety of ways. A common method of treatment which is advocated by a certain segment of society is the ingestion of chemicals and other foreign substances to correct disorders. Another method of treatment of physical disorders is to stimulate the body to utilize its natural defenses to correct the physical disorders.

The body has the ability to defend itself against almost all types of organisms or toxins that tend to damage the tissues and organs. The question that immediately comes to mind is, what types of organisms or toxins can the body fight against? Just a few of these are; drugs, chemical elements in dust, various industrial chemicals, poison ivy toxin, cancer cells, dead cells, fungus organisms, lethal bacteria and lethal viruses. Bacteria, viruses, fungi and parasites are normally present in our bodies occurring in the skin, the mouth, the intestines, the lungs, the eyes and the urinary tract as well as being exposed occasionally to very infectious bacteria and viruses that can cause deadly diseases. The body has a very complex and powerful defense system. The body has the ability to develop extreme protection against individual invading enemies. For example, certain toxins such as the paralytic toxin of botulinum can be protected against by the body's defense system in quantities as high as 100,000 times the amount that would kill the body if it did not have the defense system.

The body's defense system is constructed from white blood cells called leukocytes.

White blood cells are formed in the bone marrow and lymph tissue. The bone marrow also is a store house for white blood cells. Good nutrition is required to build good white blood cells. If the body lacks folic acid which is one of the vitamin B complex, formation of white blood cells is blocked. If formation of white blood cells is blocked, the body's defense system will become very weak and becomes a candidate for sickness. The white blood cells or leukocytes perform a variety of tasks, consequently, there is more than one type of leukocyte. There are neutrophils, eosinophils, basophils, and monocytes which protect the body by eating or ingesting the invading enemy. When they assume the role of ingesting, they are called phagocytes and the process of eating or ingesting them is called phagocytosis. There are also two other types of leukocytes called lymphocytes and plasma cells which protect the body by attaching to the invading enemy and then destroying it. It is mainly the neutrophils and monocytes that attack and destroy the invading enemy by ingesting them. The monocytes are rather weak, but when they enter the tissues they swell, increasing their diameter by as much as five times. This is a size that can be seen by the naked eye. In this form, they are called macrophages and are very powerful, becoming the first line of defense followed by neutrophils. The phagocytes know what to eat or ingest and what not to. There are three different situations that can cause phagocytosis. First, if the surface of a particle is rough, the possibility of ingestion is increased. Second, most healthy natural substances of the body have a negative charge where as most dead tissues and invading enemies have a positive charge. This is important. There is a basic rule to remember which is; "like charges repell" and "unlike charges attract". Since the phagocytes have a negative charge, the healthy natural substances will be repelled away, but dead tissue and invading enemies will be attracted to be ingested. Third, the attachment of antibodies to the invading enemy, which combination results in a positive charge making them candidates for ingestion. When the invading enemy touches the phagocytes membrane, the membrane completely encloses the invading enemy. The enclosure or bubble now breaks away from the surface of the cell. Neutrophils cannot ingest or eat particles much larger than bacteria, whereas macrophages are very powerful with the ability to ingest much larger particles than neutrophils, and often five or more times as many particles. In fact, macrophages can ingest even dead neutrophils as well as whole red blood cells and even dead tissue. In this way, the body is kept clean from unhealthy particles or substances. When a particle or substance enters the lungs that the macrophage cannot digest, it forms a giant cell capsule around the particle or substance until such time, if ever, the body can destroy it. These types of particles or substances would be tubercle organisms, silica dust particles and even carbon particles.

Eosinophils are weak phagocytes. Their main function is to detoxify foreign protein before they can cause damage to the body. They also help to dissolve old blood clots and have a special capability to ingest the invading enemy-antibody combination after the enemy has been killed.

Basophils release histamine, bradykinin, and serotonin which increase blood flow in response to tissue injury and probably heparin, which can prevent blood coagulation. Exposure to certain drugs and chemicals can prevent the bone marrow from producing white blood cells, leaving the body unprotected.

Another part of a body's defense system that was mentioned earlier was the ability to develop extreme protection against an individual invading enemy. This type of protection is called acquired immunity.

Lymphocyte cells and plasma cells are formed in the lymphoid tissue found mostly in the lymph nodes. From there, those that are destined to become what is called sensitized lymphocytes travel to the thymus gland where they are further processed to be able to assume the role of sensitized lymphocytes, and those that are destined to become antibodies travel to some unproven area where they are further processed to be able to assume the role of antibodies. The unproven area could possibly be the liver, bone marrow or intestines. When the body's defense system attacks an unhealthy substance, which could be a virus, bacteria, dead tiddue, drugs, chemicals, or whatever the body considers unhealthy, it forms sensitized lymphocytes or antibodies against each individual unhealthy substance. In effect, the body remembers each individual unhealthy substance and the next time that substance appears, it will already have sensitized lymphocytes or antibodies for that individual substance resulting in the bodies defense system being much faster, considerably stronger and endure longer. This is how a vaccination works and how it protects the body. The unhealthy substances are collectively called antigens. Antibodies take action against the invading enemies or antigens. The direct action can be done in several ways, as follows: (1) Agglutination. In this type of action, enzymes from the antibody causes numerous invading enemies to adhere to each other as if they were glued together. (2) Precipitation. In this type of action, the combination of invading enemy and antibody become a solid as if they were frozen. (3) Neutralization. This type of action results in enzymes from the antibody attacking the molecular structure of the invading enemy, thereby making it harmless, and (4) Lysis. In this type of action, enzymes from the antibody eat or ingest portions of the invading enemies cell membrane, thus causing rupture of the cell.

However, the direct action of antibodies attacking the invading enemy are not very strong or effective when compared to the indirect action called complement. This system is activated by a few antibody-enemy combinations which causes enzymes to attack the invading enemy in several different ways at the same time. The body's defense has a combined action: (A) Lysis enzymes from the antibody ingest portions of the invading enemies cell membrane, thus causing rupture of the cell. (B) The antibody enzymes also cause the antibodyenemy combination to become more positively charged to increase the possibility to be ingested by a neutrophil or macrophage. (C) The complement releases a product that acts like a call for help to neutrophils and macrophages to come and help fight. (D) Agglutination enzymes from the antibody causes numerous invading enemies to adhere to each other as if they were glued together. (E) Neutralization antibody enzymes attack the molecular structure of the enemy, making it harmless.

The sensitized lymphocytes perform against the invading enemy. As with the antibodies, there is a direct action and an indirect action. The direct action is weak when compared to the indirect action. In the direct action, upon contact with the invading enemies membrane, the sesitized lyphocyte swells and releases enzymes to attack the invading enemy. The indirect action is more effective. (A) The sensitized lymphocytes release a substance that causes the surrounding small nonsensitized lymphocytes in the tissues to take on the characteristics of the sensitized lymphocytes and attack the invading enemy. (B) The sensitized lymphocytes also releases a substance that acts like a call for help to as many as 1,000 macrophages. (C) The sensitized lymphocytes release another substance that causes the marcrophages to ingest as many invading enemies as possible.

The body functions through the endocrine system, the body's natural defense system, and the digestive system. There are two major control systems in the body. One being the nervous system and the other is the endocrine system. The endocrine system is constructed of several glands that secrete hormones in the blood to cause actions at distant points in the body. The glands within this system are primarily the pituitary, adrenal, thyroid, parathyroid, pancreas, thymus, pineal, and reproductive. Basically, the endocrine system is concerned with control of the different metabolic functions of the body, such as controlling the rates of chemical reactions in the cells or the transport of substances through cell membrances or other aspects of cellular metabolism like growth and secretion. The principal means of communication between these glands is through hormonal secretion. A hormone is a chemical substance made up of proteins or steroids which are transported through the blood to distant points in the body. For example, the growth hormone is a small protein molecule and in turn, the small protein molecule is constructed of 191 amino acids. These hormones carry instructions from one gland to another gland. The pituitary gland is a small gland that is located at the base of the brain. The pituitary is divided into two sections. The pituitary, as a whole, secretes eight important hormones, plus several less important hormones. The following is a description of the eight important hormones: (1) Growth hormone; This hormone causes growth of all tissues of the body that are capable of growing. It promotes both increased size and number of cells. (2) Adrenocorticotropin; This hormone controls the secretion of the adrenal gland. (3) Thyroidstimulating hormone; This hormone controls the secretion of the thyroid gland. (4) Prolactin; This hormone promotes mammary gland development and milk production. (5) Folliclestimulating hormone; (6) Luteninizing hormone; These two hormones control the growth, and activities of the reproductive organs. (7) Antidiuretic hormone, also called, vasopressin; This hormone controls the rate of water excretion into the urine, and as a result, helps to control the amount of water in the body fluids. (8) Oxytocin; This hormone helps to deliver milk from the glands of the breast to the nipples during suckling.

The adrenal glands are located at the top of the two kidneys. Each adrenal gland is made up of two distinct parts. One part is called the adrenal medulla, and the other part is called the adrenal cortex. The adrenal medulla secretes two hormones and the adrenal cortex secretes over thirty different hormones. Of these thirty, two are of major importance to the endocrine system. The adrenal gland receives the stimulating hormone adrenocorticotropin from the pituitary, and in turn, the adrenal gland secretes the two hormones we are interested in, namely: (1) Aldosterone. This hormone controls the important sodium-potassium balance in the body, or in other words, functions in the regulation of the salt and water balance of the body. For a review, we could refer back to the brief description of the minerals and look up sodium and potassium. (2) Cortisol. This hormone has an important effect in the metabolism of carbohydrates, protein, and fats. A lack or excess of this hormone upsets your blood-sugar balance and your body's ability to properly utilize protein and fats.

The adrenal gland is one of the glands that receives tremendous strain when large amounts of refined sugar is consumed. The thyroid gland is located at the base of the neck in the front. The thyroid gland receives the thyroidstimulating hormone from the pituitary, and in turn, the thyroid gland secretes two significant hormones; namely: thyroxine and triildothyronine. These two hormones basically perform the same function. The difference between them is that thiiodothyronine is about four times stronger and faster than thyroxine, but only lasts a short time compared to the thyroxine. These two thyroid hormones have two major effects on the body, one being an increase in the overall metabolic rate, and the other is stimulation of growth in children. The thyroid hormones increase the metabolic rate of almost all tissues of the body. The rate of utilization of foods for energy is greatly increased. The mental processes are excited, and the activity of many other endocrine glands is often increased. The thyroid hormone stimulates almost all aspects of carbohydrate (sugar) and fat metabolism. Increased thyroid hormone decreases the quantity of cholestrol, phospholipids, and triglycerides in the blood. Because thyroid hormone increases the quantities of many of the different enzymes and because vitamins are essential parts of some of the enzymes or coenzymes, thyroid hormone causes increased need for vitamins. Lack of thyroid hormone causes constipation. Excess thyroid hormone is likely to cause extreme nervousness, anxiety problems, extreme worry, or paranoias. Greatly increased thyroid hormone production almost always decreases the body weight and greatly decreased production almost always increases body weight. Increased thyroid hormone increases the rates of secretion of most other endocrine glands, but it also increases the need of the tissues for the hormones. As an example, increased thyroxine secretion increases the rate of glucose metabolisum everywhere in the body and therefore causes a corresponding need for increased insulin secretion by the pancreas. If any of the endocrine glands speed up or slow down, there is an effect throughout the body. The endocrine system is one of the major control systems of the body.

The parathyroid glands are located immediately behind the thyroid gland. Normally there are four parathyroid glands. The parathyroid glands play a major role in the metabolism of calcium and phosphate, the use of vitamin D, and the formation of bone and teeth. Phosphate is easily absorbed from the intestine, but calcium, because of the way it is constructed, is difficult to absorb. Parathyroid hormone, vitamin D, the liver, and the kidneys have a large control of the absorption and use of calcium, and because of this, a secondary effect on phosphate.

For the body to be healthy, it must have control over basically all functions. Vitamin D3 (cholecalciferol) has a major effect on absorbing calcium from the intestines, also removing and replacing calcium in the bones. Vitamin D3 in its natural form, cannot accomplish this. It must first be converted by the liver to 25 hydroxycholecalciferol, and then by the kidneys to 1,25 dihydroxycholecalciferol, which is a hormone and controls the absorption of calcium from the intestine. Vitamin D3 can be obtained from food, the sun, and food supplements. The liver acts as a store house for vitamin D3. It can store vitamin D3 for as long as several months. The liver also monitors the amount of 25 hydroxycholecalciferol it produces to achieve the necessary control over it. The kidneys control how much 1,25 dihydroxycholecalciferol it produces. This has a very powerful control over how much calcium is absorbed from the intestines. To achieve this powerful control, the body uses the parathyroid glands to monitor the blood concentration of calcium and they in turn control the kidneys. The parathyroid glands control the kidneys through the use of parathyroid hormone. At the same time that the parathyroid hormone controls the kidney, it also controls the renewing of all of the bones.

The bones are continually being renewed by removing old calcium (bone) and then putting back new calcium (bone). The removal process is done by what is called osteoclasts. The old calcium (bone) is replaced in a process called osteoblasts. Parathyroid hromone not only controls the kidney, but also the renewing of the bones. This is accomplished in the following way. When the blood calcium concentration goes down, the parathyroid glands secrete parathyroid hormone which not only activates the kidneys, but also activates the osteoclasts, thereby removing old calcium (bone). When the blood calcium concentration goes high, the parathyroid glands stop secreting parathyroid hormone, which not only inactivates the kidney, but activates the osteoblasts, which go about the job of filling in with new calcium all of the places where it had been removed.

It is possible for calcium to form deposits where it is not suppose to, for example, in arteries. The body is designed to prevent calcium from being deposited anywhere except in the bones. When this control is lost, calcium can be deposited and harden in arteries (arteriosclerosis or hardening of the arteries), in old blood clots or degenerating tissues. When the calcium is below normal or above normal, the results are immediate and extreme. When the calcium is below normal, the nervous system becomes more and more jumpy and irritable. The nervous system becomes so jumpy that it results in extreme muscle spazms. In fact, the final results of this can be convulsions and death. When the calcium is above normal, the nervous systems becomes depressed and sluggish along with constipation with lack of appetite. In the absence of the kidneys vitamin D3 is almost totally ineffective. This in turn makes it difficult, if not impossible for the intestines to absorb calcium. Also, if the parathyroid glands should slow down, the result again is little or no absorption of the calcium from the intestines with the extreme effects already discussed. If the parathyroid glands should become over active, or speed up, there will be extreme osteoclastic activity in the bones, or to say it in another way, the bones will become eaten away. Because of this, they become weak and easily broken, Also, the blood calcium level will go high with the effects already mentioned. Along with all of this is the extreme tendency to form kidney stones.

Two important hormones, insulin and glucagon, are secreted by the pancreas. They effect gluocse (sugar), lipid (fat), and protein metabolism. The portion of the pancreas that contains insulin and glucagon is called islets of langerhans. The islets of langerhans secrete insulin from what is called beta cells and glucagon from alpha cells. These beta cells become nonfunctional in a person with severe diabetes and therefore secrete very little, if any, insulin. On the other hand, if the beta cells become over active, they will secrete too much insulin and the condition, known as, hypoglycemia can result. The liver plays a very important part in achieving this control. In fact, in persons with severe liver disease, it becomes almost impossible to maintain the correct blood sugar level. All cells in the body require energy, therefore, the body uses glucose when it is available, but can switch to fats or proteins when glucose is not available.

Introduction of a high carbohydrate (sugar) meal causes the amount of sugar in the blood to increase, and the amount of increase depends on how much sugar was introduced. One of the functions of the pancreas is to control the amount of sugar in the blood because low blood sugar or high blood sugar is dangerous. When the pancreas senses a high blood sugar condition, it secretes a hormone called insulin from the beta cells in the islets of langerhans. Insulin causes most of the cells in the body to use glucose (sugar) for its energy. Insulin causes the liver to store about sixty percent of the glucose consumed in the form of glycogen to be used later when no food is being consumed. Once the liver has stored all of the glucose it can, all of the additional glucose entering the liver becomes available to form fat. These fatty acids are then transported to fat cells where they are stored. When the cells are using glucose for energy, the fat storage is preserved. Insulin promotes entry of amino acids (protein) into cells for protein storage. Insulin increases the speed of protein formation. Insulin also prevents proteins from being converted to glucose, threby preserving the protein storage.

Without insulin, glucose (sugar) cannot be transported into most of the cells of the body (with the exception of the brain, retina of the eye, and gonads) to be used as a source of energy. Glucose can not be transported into the liver, therefore, no store house of glucose could be formed and consequently, no fatty acids could be formed and stored in the fat cells. In the absence of insulin, the process of fat storage is reversed to an extreme extent, releasing large quantities of fatty acids into the blood stream. This causes a large increase in cholesterol, leading to atherosclerosis, heart attacks, strokes, etc. The excess of fatty acid causes the liver to become very fat, as well as releasing excessive amounts of acetoacetic acid, which can cause severe acidosis, coma, and without treatment, death. Without insulin, all protein formation and storage stops, in fact, large quantities of amino acid (protein) are dumped into the blood stream, eventually emptying the store house. This wasting of protein will lead to extreme weakness as well as to many deranged functions of the organs.

When the insulin process has returned the glucose (sugar) level back to normal, insulin secretion slows down and eventually stope. Now, as the glucose is used as energy, primarily by the brain, the blood glucose level starts to go low. As the blood glucose level starts to fall below normal, the pancreas senses this, and realizes it must do something to bring the blood glucose level back to normal. Glucose is the only source of energy for the brain. Therefore, if the blood glucose level remained low, the brain would starve. So in response to this, the islets of langerhans secrete from the alpha cells a hormone called glucagon which causes the liver to reconvert stored glycogen to glucose to bring the blood glucose level back to normal. An important point here is that when the insulin level went down, this caused most of the cells to switch from using glucose for energy, to using fat for energy. If this way, most of the stored glycogen in the liver can be used to supply the brain with the necessary energy. A condition of low blood sugar is called hypoglycemia. Some of the symptoms could be; exhaustion, anxiety, dizziness, moodiness, depression, irritability, obesity, nervousness, allergies, insomnia, headaches, fainting, convulsions, and even coma. Hypoglycemia or low blood sugar occurs if the pancreas is not functioning correctly and secreted too much insulin between meals. This would immediately switch most of the cells back to glucose for energy and leave the brain without an adequate supply of energy. The liver is involved in this control and in people with a severe liver disease, it becomes almost impossible to maintain a narrow range of blood glucose concentration.

The foregoing information of the natural body's defenses and the operation of the various portions of the body is well known. In spite of the fact that the selfhealing aspects of the body are well known, a substantial portion of individuals in the healing arts insist upon treating body maladies by the introduction of various chemicals and antibiotics in an effort to produce healing. It is well known that the introduction of chemicals and antibiotics in most instances has side effects. In many cases, the side effects are particularly undesirable. These so-called side effects can and often do produce other maladies.

There is a portion of the practitioners of the healing arts who recognized that it is possible to heal the human body by stimulating the body to activate certain portions of the body to increase the effectiveness of the natural defense system of the body. A well known system of treatment is acupuncture, which stimulates the natural defense system by inserting a needle into a selected portion of the body to stimulate the operation of a selected gland or organ. Another system for stimulating the natural defense system is called acupressure or reflexology.

The system of reflexology utilizes the application of a localized force to a selected reflex point in the body. The reflex point, when activated, stimulates the natural defense system for a certain selected portion of the body. The reflex points are situated in various parts of the body. There are reflex points on the head and on the hands. Also, there are reflex points on the feet. These reflex points are generally well charted. For instance, the relfex points for stimulating the natural defense system for the eyes and ears are adjacent to the anterior portion of the metatarsus arch. In certain instances, the fingers or knuckles of a therapist are used to apply the localized force to a selected portion of a body to stimulate the body's natural defense system to even a greater degree of activity than that caused by the invasion of an undesirable cell.

It is generally recognized that though the general location of reflex points is well known, not all persons have their reflex points in exactly the same relative position. As a result, the therapist, utilizing his fingers, must apply a force at one locale, and then move a short distance to another locale to apply force in a general area in order to make certain that the proper reflex point is activated. This form of treatment is tiring to the therapist, and has another disadvantage of being time consuming. The utilization of a tool by the therapist is recognized. U.S. Pat. No. 3,831,592, issued Aug. 27, 1974, to William E. Lancellotti, entitled, "Trigger Point Instrument", is such a tool wherein the instrument provides a member for transmitting the force to a reflex point or trigger point, as is identified by Lancellotti. The Lancellotti device still requires the operator to apply the instrument to a series of points in order to be certain of engaging the appropriate reflex point to affect the desired treatment. This requires the application of the force and the lifting of the instrument from that point and transferring the instrument to another point before a force is applied.

The prior art does not disclose a wheeled tool for the application of a localized force to a reflex point. There are a number of devices which are well known for massaging a body. These devices are disclosed in the following patents: U.S. Pat. No. 1,071,998, issued Sept. 2, 1913, to Gibbs, entitled, "Massage Device"; U.S. Pat. No. 3,037,500, issued June 5, 1962, to Daugherty, entitled, "Foot Massager"; U.S. Pat. No. 2,273,710, issued Feb. 17, 1942, to Klaes, entitled, "Massage Device"; U.S. Pat. No. 3,672,356, issued June 27, 1972, to Possick, entitled, "Abdominal Muscle Exercise Device"; U.S. Pat. No. 3,850,163, issued Nov. 26, 1974, to Andis, Sr., entitled, "Stride And Knead Massager"; and U.S. Pat. No. 3,664,334, issued May 23, 1972, to O'Neil, entitled, "Massage Wheel". Each of the patents dealing with wheeled devices is directed to massaging, that is, manipulating the muscle fibers, and none of the disclosures are directed to a reflex point. It is therefore a principal object of the present invention to provide a reflex stimulator which is utilized to apply a localized force in rapid succession to a number of points in a given general area of a human body in order to activate a selected reflex point to stimulate the operation of a body's natural defense system for a given organ, gland, or area of the body.

SUMMARY OF THE INVENTION

The present invention relates to an improved reflex stimulator which applies a localized force in a series of applications by rolling the device over a selected area of a human body to apply a force to a selected nerve ending at a trigger point. The instant instrument includes a handle for grasping the instrument and to provide a means for applying a force to the instrument. A hub having an axis of rotation is rotatably connected to the handle. The hub has a plurality of elongated teeth mounted on its outer periphery. Each of the teeth extends radially outward from the hub and each tooth has its longitudinal axis intersecting the axis of rotation of the hub. Each tooth has a free end for engagement with a treated portion of a human body for applying a localized force to the human body. Each tooth has its free end tapered to a substantially flat end, and said flat end has a cross sectional area less than one-fourth the cross sectional area of the respective tooth adjacent to the hub.

DESCRIPTION OF THE PREFERRED EMBODIMENTS

Figure 1:
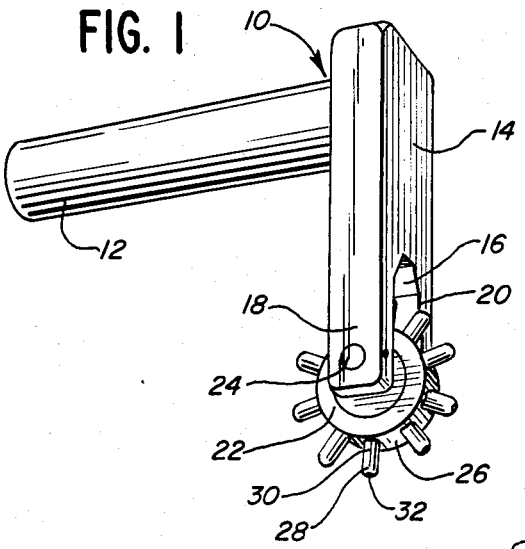
FIG. 1 is a perspective view of a reflex stimulator embodying the herein disclosed invention wherein the stimulator includes a single row of teeth.

Referring now to the drawing and especially to FIG. 1, a reflex stimulator generally indicated by numeral 10 is shown therein and is a specific embodiment of the herein disclosed invention. Stimulator 10 includes an elongated cylindrical handle 12, which is particularly adapted to be grasped by an operator for manipulating the stimulator. A yoke 14 is fixed to handle 12. Yoke 14 includes a slot 16 defined by a pair of ears 18 and 20. A cylindrical hub 22 is rotatably mounted on an axle 24, which axle is fixed in ears 18 and 20. Hub 22 has an axis of rotation which is generally transverse to the length of handle 12. Hub 22 has an outer periphery 26, which has a plurality of identical elongated teeth 28 mounted thereon.

Teeth 28 extend radially outward from the outer periphery of the hub. Each tooth has an elongated cylindrical body 30 with its free end tapered to a flat contact end 32. Each cylindrical body has its longitudinal axis positioned radially outward from the outer periphery of the hub and the longitudinal axis intersects the axis of rotation of the hub. The teeth are arranged in the same plane, and the plane of the teeth is perpendicular to the axis of rotation of the hub. The teeth are equiangularly spaced from each other with 36° between adjacent teeth.

Reflex stimulator 10 has a specific construction wherein the hub is cylindrical and has a diameter of one inch. Each tooth extends three-eights of an inch outward from the outer periphery of the hub. The diameter of each tooth adjacent to the hub is three-sixteenth of an inch and the diameter of the flat contact end is three-thirty seconds of an inch.

Reflex stimulator 10 is particularly adapted for use on certain parts of the body, to wit, the tops and bottoms of feet, the inside and outside of hands, the head, forearms, chest and the lower portion of the leg below the knee.

Figure 2:
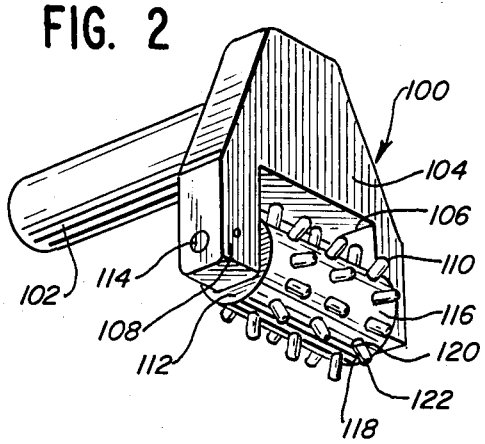
FIG. 2 is a perspective view of a reflex stimulator similar to the stimulator shown in FIG. 1 but having three rows of teeth.

Referring now to FIG. 2, a reflex stimulator generally indicated by numeral 100 is shown therein, which reflex stimulator 100 is similar to reflex stimulator 10. However, reflex stimulator 100 has three rows of teeth rather than a single row of teeth as has reflex stimulator 10. Reflex stimulator 100 includes a handle 102 with a yoke 104 fixed to handle 102. Yoke 104 includes a slot 106 with a pair of ears 108 and 110 defining slot 106. An elongated cylindrical hub 112 is rotatably mounted in slot 106. An axle 114 is mounted in ears 108 and 110. Hub 112 rotates on axle 114 with its axis of rotation substantially transverse to the length of handle 102.

Hub 112 which has the same diameter as hub 22 includes an outer periphery 116 which has a plurality of identical elongated teeth 118 equiangularly fixed thereon. Each of the teeth 118 includes an elongated cylindrical body 120 with its free end tapered to a flat contact end 122. Teeth 118 are identical to teeth 28, except for flat contact end 122 which is smaller than flat contact end 32. Flat contact end 122 has a diameter of three-eightieths of an inch. Each tooth 118 extends radially outward from the outer periphery of hub 112 so that its longitudinal axis extends through the axis of rotation of hub 112.

Teeth 118 are arranged in three separate planes. One-third of the teeth is arranged in a plane adjacent to ear 108. Another one-third of teeth 118 is arranged in a plane which is adjacent to ear 110. The remainder of the teeth is arranged in a plane which is equidistant from the other two planes. In each plane, the teeth are equiangularly spaced from each other with 36° between adjacent teeth in a given plane. Each tooth in each plane is aligned in a straight line with a tooth from each of the other planes so that the teeth in a given line define a plane which extends through the axis of rotation of the hub.

Figure 3:
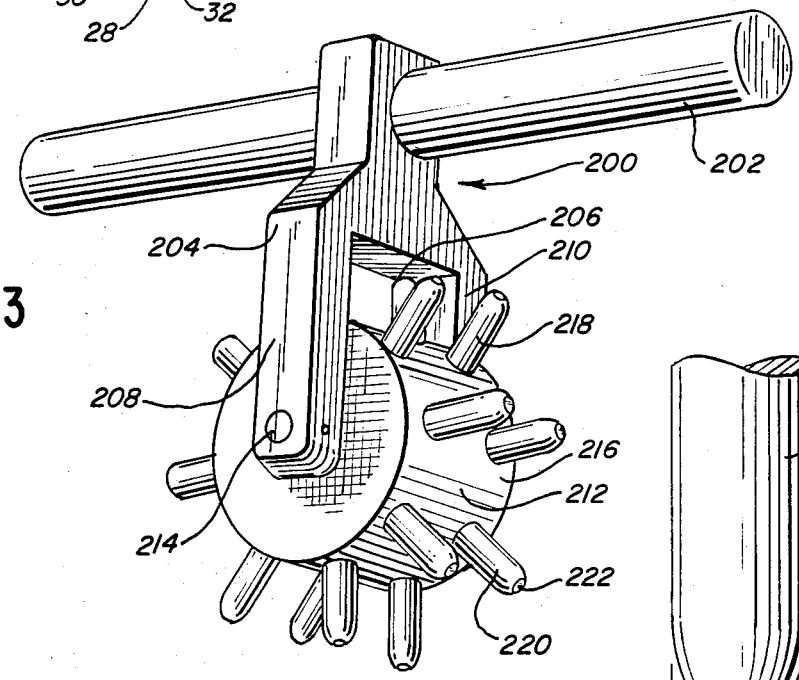
FIG. 3 is a perspective view of a reflex stimulator similar to the reflex stimulator of FIG. 1 but having a larger hub and having two rows of teeth.

Reflex stimulator 100 is used on portions of a body which are generally curved, such as the head, back of the head, the upper portion of the feet, or the lower portion of the lower extremity formed by the tibia. The three rows of teeth prevent skating of the stimulator on the body as it is moved across the body. Referring now to FIG. 3, another specific embodiment of the subject invention; to wit, reflex stimulator 200, is shown therein. Reflex stimulator 200 includes an elongated cylindrical handle 202 which has a yoke 204 fixed to the center of the handle. Yoke 204 includes a slot 206 defined by a pair of ears 208 and 210. A cylindrical hub 212 is rotatably mounted on an axle 214, which axle 214 is fixed between ears 208 and 210. Hub 212 has its axis of rotation substantially transverse to the length of handle 202.

Hub 212 has an outer periphery 216, which has a plurality of elongated teeth 218 mounted thereon. Teeth 218 are identical in construction. Each tooth 218 has an elongated cylindrical body 220 with its free end tapered to a flat contact end 222. Each tooth extends radially outward from the hub so that the longitudinal axis of the tooth intersects the axis of rotation of the hub.

One-half of teeth 218 is positioned in one plane which is perpendicular to the axis of rotation. The remaining teeth are positioned in another plane, which is parallel to the first mentioned plane. The teeth in each plane are aligned with like teeth in the other plane so that each pair of adjacent teeth in the two planes defines a plane which extends through the axis of rotation.

In a specific construction of the subject stimulator 200, hub 212 has an outside diameter of two inches. Each of teeth 218 has a diameter of five-sixteenths of an inch at its fixed end portion of the body and a length of three-fourths of an inch from the outer periphery of the hub to flat face 222. Each tooth has its flat end particularly adapted for engagement with a human body to apply a localized force to the human body at a reflex point to affect a nerve end at that reflex point. The teeth on reflex stimulator 200 are equinagularly spaced from adjacent teeth and the distance between adjacent teeth in one plane is 45°.

Figure 5:
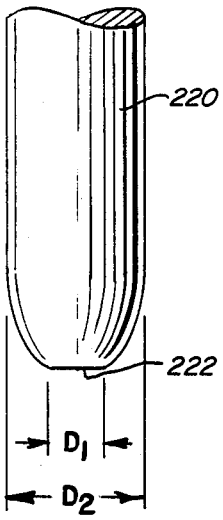
FIG. 5 is an enlarged fragmentary view of one of the teeth of the stimulator of FIG. 3.
Figure 6:
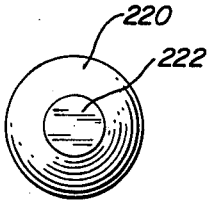
FIG. 6 is an end view of the tooth of FIG. 5.

Through the investigation of various configurations of teeth on the reflex stimulators, it has been found that the construction of each tooth, irrespective of size, must have a similar shape. The end of each tooth should be tapered as shown in FIGS. 5 and 6. In the case of a tooth having a circular cross section, it has been found that the relationship of the diameter of the flat contact surface $D_1$ should be no greater than one-half the diameter of the cylindrical body of the tooth $D_2$ so that the area of the flat contact surface should be no greater than one-fourth of the cross sectional area of the body of the tooth. It has also been found that there must be a flat surface. The diameter of the flat surface $D_1$ must be at least one-fifth of the diameter $D_2$ of the cross section of the body so that the area of the flat contact surface must be at least one-twenty-fifth of the area of the cross section of the body of the tooth.

Figure 4:
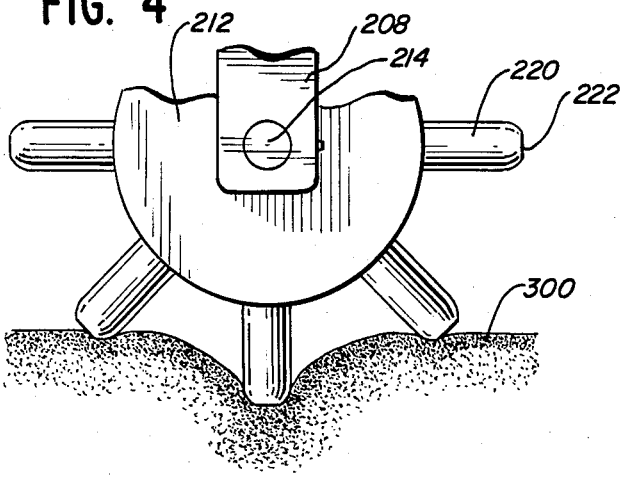
FIG. 4 is a side elevational view showing a portion of the stimulator of FIG. 3 being applied to a human body.

Each of the reflex stimulators described in detail above operates in the same manner. An operator grasps the handle and applies a force to the stimulator so that the stimulator is pushed against the surface of a body to be treated. Referring now to FIG. 4, it may be seen how a pair of teeth of stimulator 200 is depressed against the skin of a body 300. The spacing between adjacent teeth in one plane is such that a tooth may be pushed down into the flesh of the human body to apply a force to a reflex point while adjacent teeth simply contact the skin. Simultaneously with the application of the force against the body, the operator moves the stimulator substantially parallel to the surface of the body so that the hub rotates on its axis and then another tooth is placed into position to apply a force to a point on the body. The operator moves the stimulator back and forth in a zone having the reflex point so that the reflex point is stimulated by the application of a localized force. It is important to note that the three stimulators disclosed herein operate on the same mode of operation, the difference being in size to accommodate different parts of the body. The multiple rows of teeth are used to prevent the stimulator from skating across the surface of the body when it is used on such portions of the body as the head, the lower half of the lower extremity, the back of the hand or the upper portion of the foot.

As was described above, the instant reflex stimulators apply a localized force to a reflex point. The utilization of the instant reflex stimulators allows an area to be saturated with a plurality of applications of a localized force, thereby assuring that a reflex point is activated since it is difficult to determine the exact location of each reflex point on a given body. The positioning of reflex points varies with each individual as the height, weight, and eye color varies with each individual.

The specific construction of the teeth has been found to be the optimum construction for applying a localized force. The flat portion of each tooth in connection with tapered portions has been found to be the most effective construction for the application of the localized force. It has been found that the specific construction of the teeth utilized on the subject reflex stimulators has produced improved results, wherein the application of the localized force has stimulated activity of selected glands in order to generate the operation of the body's natural defense system without the introduction of chemicals and/or antibiotics with the undesirable side effects.

Although specific embodiments of the herein disclosed invention have been shown in the accompanying drawing and described in detail above, it is readily apparent that those skilled in the art may make various modifications and changes without departing from the spirit and scope of the present invention. It is to be understood that the instant invention is limited only by the appended claims.

What is claimed is:

1. A reflex stimulator for applying a localized force to a nerve ending at a reflex point in a series of points on a human body comprising: a handle providing a means to allow an operator to grasp the reflex stimulator and manipulate the stimulator while applying a force to a human body with the reflex stimulator, a hub rotatably connected to the handle, said hub having an outer periphery and an axis of rotation within its outer periphery, and a plurality of elongated teeth mounted on the outer periphery of the hub and extending radially outward from the hub, each of said teeth having a free end adapted for engagement with a human body to apply a localized force to a selected portion of the human body, each of said teeth having its free end tapered to a substantially flat end, said flat end having a cross sectional area less than one-fourth the cross sectional area of the respective tooth adjacent to the hub, said teeth being equiangularly spaced about the outer periphery of the hub, said teeth being arranged in a plane substantially perpendicular to the axis of rotation of the hub, each of said teeth being spaced from adjacent teeth a distance to allow a given tooth to depress the skin of a human body to have the given tooth's free end stimulate a selected reflex point on the human body while the teeth on either side of the given tooth may engage the skin surrounding the skin engaged by the given tooth without reducing substantially the force applied to the selected reflex point by the given tooth, and movement of the handle relative to the body causes the hub to rotate and causes another of the teeth to engage another point on the human body to apply a localized force to the other point of the human body for applying a localized force to each of a plurality of points on the human body in a selected zone to insure applications of localized force to a selected reflex point.

2. A reflex stimulator for applying a localized force to a nerve ending at a reflex point in a series of points on a human body as defined in claim 1, wherein each flat end has a cross sectional area greater than one-twenty-fifth of the cross sectional area of the respective tooth adjacent to the hub.

3. A reflex stimulator for applying a localized force to a nerve ending at a reflex point in a series of points on a human body as defined in claim 1, wherein a second plurality of teeth equal in number to the first mentioned plurality is arranged in a second plane spaced from and substantially parallel to the first mentioned plane.

4. A reflex stimulator for applying a localized force to a nerve ending at a reflex point in a series of points on a human body as defined in claim 1, wherein a second plurality of teeth equal in number to the first mentioned plurality is arranged in a second plane spaced away from and substantially parallel to the first mentioned plane, and each tooth is the second plane is aligned with a tooth in the first mentioned plane to define a plane extending through the axis of rotation of the hub.

5. A reflex stimulator for applying a localized force to a nerve ending at a reflex point in a series of points on a human body as defined in claim 1, wherein a second plurality of teeth equal in number to the first mentioned plurality being in a second plane spaced from and substantially perpendicular to the first mentioned plane, and a third plurality of teeth equal in number to the first mentioned plurality being in a third plane equidistantly spaced from the first mentioned plane and the second plane and being substantially parallel to the first mentioned plane.

6. A reflex stimulator for applying a localized force to a nerve ending at a reflex point in a series of points on a human body as defined in claim 1, wherein a second plurality of teeth equal in number to the first mentioned plurality being in a second plane spaced from and substantially parallel to the first mentioned plane, and a third plurality of teeth equal in number to the first mentioned plurality being in a third plane spaced equidistantly from the first mentioned plane and second plane and substantially parallel to the first mentioned and second planes, each tooth in the third plane being aligned with a tooth in the first mentioned plane and a tooth in the second plane to define a plane extending through the aligned teeth and the axis of rotation of the hub.

7. A reflex stimulator for applying a localized force to a nerve ending at a reflex point in a series of points on a human body as defined in claim 1, wherein a second plurality of teeth equal in number to the first mentioned plurality being in a second plane spaced from the first mentioned plane and substantially perpendicular to the axis of rotation of said hub, and a third plurality of teeth equal in number to the first mentioned plurality being in a third plane spaced from the first mentioned plane and the second plane and substantially parallel to the first mentioned plane, each flat end of each tooth having a cross sectional area greater than one-twenty-fifth of the cross sectional area of the respective tooth adjacent to the hub.

* * * * *

UNITED STATES PATENT AND TRADEMARK OFFICE

CERTIFICATE OF CORRECTION

PATENT NO. : 4,622,956

DATED : November 18, 1986

INVENTOR(S) : David A. Nesheim

It is certified that error appears in the above-identified patent and that said Letters Patent are hereby corrected as shown below:

Column 7, Line 29, Cancel "stope" and substitute therefor --stops--

Signed and Sealed this

Third Day of February, 1987

*Attest:*

DONALD J. QUIGG

*Attesting Officer*

*Commissioner of Patents and Trademarks*